United States Patent [19]

Pfarrwaller

[11] 4,276,911

[45] Jul. 7, 1981

[54] TAKE-OFF APPARATUS FOR THE FABRIC WEB OF A TEXTILE MACHINE, ESPECIALLY A LOOM

[75] Inventor: Erwin Pfarrwaller, Winterthur, Switzerland

[73] Assignee: Sulzer Brothers Limited, Winterthur, Switzerland

[21] Appl. No.: 90,694

[22] Filed: Nov. 2, 1979

[30] Foreign Application Priority Data

Dec. 5, 1978 [CH] Switzerland ..... 12385/78

[51] Int. Cl.[3] ..... D03D 49/20

[52] U.S. Cl. ..... 139/308; 26/105

[58] Field of Search ..... 139/291 R, 304, 307, 139/308; 66/149 R; 242/76; 26/105 X

[56] References Cited

U.S. PATENT DOCUMENTS

| | | | |
|---|---|---|---|
| 2,717,037 | 9/1955 | Goodwillie | 242/76 |
| 2,884,015 | 4/1959 | Bechter | 26/105 |
| 3,405,884 | 10/1968 | Patterson | 242/76 |
| 3,645,300 | 2/1972 | Geven et al. | 139/308 |
| 3,885,600 | 5/1975 | Altmann | 26/105 |
| 3,910,319 | 10/1975 | Bassing et al. | 139/308 |

*Primary Examiner*—Henry Jaudon

*Attorney, Agent, or Firm*—Werner W. Kleeman

[57] ABSTRACT

At a fabric take-off apparatus the deflection rod arranged forwardly of the cloth take-off roll, is provided at both halves thereof with opposite pitch threaded grooves and, if desired, at the ends thereof with spreader-needle rolls. The fabric, directly after travelling on to the take-off roll, is stretched in its width. Upon departing from the take-off roll the fabric or cloth, at the region where it leaves the take-off roll and arrives at a deflection roll, therefore does not tend to become wider due to the appreciably lower tension of the cloth beam. In this way the formation of creases or folds in the fabric cloth is avoided, which otherwise could be permanently formed at the contact location or nip between the cloth take-off roll and the subsequently arranged deflection beam or roll.

11 Claims, 4 Drawing Figures

TAKE-OFF APPARATUS FOR THE FABRIC WEB OF A TEXTILE MACHINE, ESPECIALLY A LOOM

BACKGROUND OF THE INVENTION

The present invention broadly relates to the field of textile machines, and, more specifically, relates to a new and improved construction of a take-off apparatus for the cloth or fabric web of a textile machine, especially a loom.

In its more particular aspects the take-off apparatus of the present development is of the type comprising a driven cloth or fabric take-off roll and a respective substantially rod-shaped deflection element for the fabric or cloth. One such rod-shaped deflection element is arranged forwardly and the other rearwardly of the cloth take-off roll, these deflection elements bearing against such take-off roll while there is interposed therebetween the cloth or fabric. Both of the deflection elements are stationarily arranged and the cloth take-off roll is arranged to be moveable transversely with respect to the lengthwise axis of the cloth take-off roll. The inner spacing of the deflection elements from one another, meaning the spacing between the confronting surfaces of the deflection elements, is smaller than the diameter of the cloth take-off roll.

With a heretofore known cloth take-off apparatus of this type the deflection element, arranged forwardly of the cloth take-off roll and constructed as a roll, has a smooth surface and is entrained, in other words rotated, by the cloth or fabric which passes thereover and arrives at the cloth take-off roll.

Under the influence of the pronounced take-off tension exerted by the take-off apparatus it is possible for there to occur a pronounced contraction of the cloth or fabric at the region between the beat-up of the reed or spreader on the one hand and the cloth take-off roll on the other hand, i.e. the fabric web can become appreciably narrower before it travels onto the cloth take-off roll.

Upon departure of the cloth from the cloth take-off roll there is exerted upon the cloth, by the action of the cloth beam, the cloth beam-take-off tension which as a general rule is appreciably less. If desired, the cloth even can be deposited completely without any tension into a container or the like. Consequently, the cloth or fabric can again spread at this region due to the action of the weft thread tension, so that there are formed folds. These folds can be permanently pressed into the cloth at the nip between the cloth take-off roll and the subsequently arranged deflection roll.

SUMMARY OF THE INVENTION

Therefore, with the foregoing in mind it is a primary object of the present invention to provide a new and improved construction of take-off apparatus for the fabric web of a textile machine, especially a loom, which is not afflicted with the aforementioned drawbacks and limitations of the prior art proposals.

Another and more specific object of the present invention aims at providing a new and improved construction of take-off apparatus of the character described which effectively prevents or at least appreciably minimizes the formation of folds in the fabricated cloth or fabric.

Another and more specific object of the present invention aims at the provision of a new and improved construction of take-off apparatus for the fabric web of a textile machine, especially a loom, which take-off apparatus is relatively simple in construction and design, economical to manufacture, extremely reliable in operation, and effectively avoids the drawbacks of the prior art constructions noted above and eliminates the formation of undesired folds in the cloth which is being taken-up by the take-off apparatus.

Now in order to implement these and still further objects of the invention, which will become more readily apparent as the description proceeds, the invention contemplates that the deflection element, arranged forwardly or upstream of the cloth take-off roll, viewed with respect to the direction of cloth travel, itself is constructed as a spreader device for the cloth or fabric. In this way it is possible to permit the cloth to travel onto the cloth take-off roll in a particularly widely spread position. When the cloth departs from the cloth take-off roll or already shortly before this event, the cloth arrives with the lesser tension at the take-off side. However, since it already possesses the full cloth width due to the action of the spreader device, there can be beneficially avoided any further spreading or widening of the cloth due to let-up of the lengthwise tension. Hence, as tests have shown it is therefore possible to beneficially avoid the formation of creases in the cloth, which heretofore could arise during cloth departure from the take-off apparatus, especially due to the pressure exerted by the subsequently arranged deflection element.

BRIEF DESCRIPTION OF THE DRAWINGS

The invention will be better understood and objects other than those set forth above, will become apparent when consideration is given to the following detailed description thereof. Such description makes reference to the annexed drawings wherein.

DETAILED DESCRIPTION OF THE PREFERRED EMBODIMENTS

Figure 1:
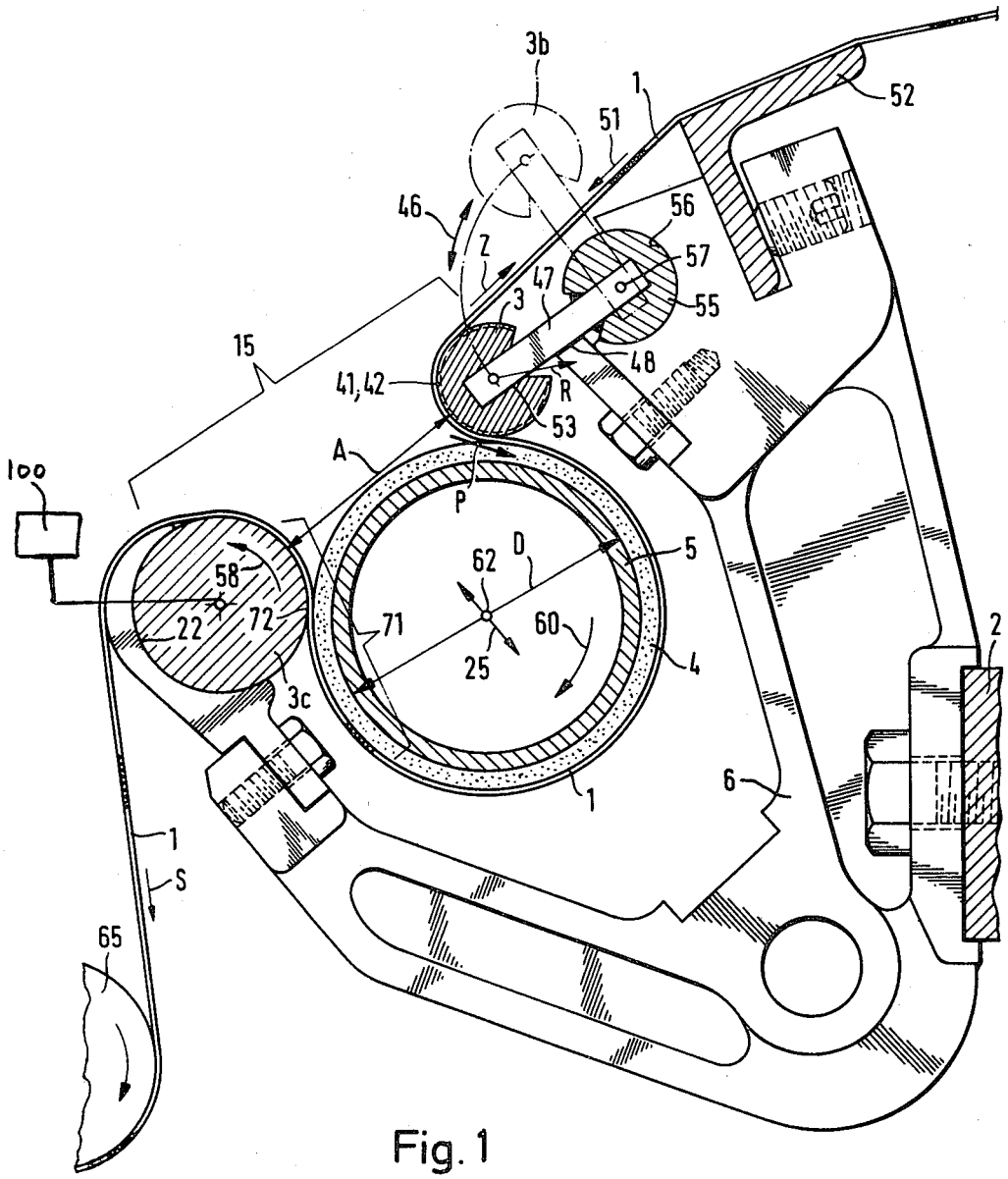
FIG. 1 is a side view, partially in section, through a cloth take-off apparatus according to the invention shown arranged at a loom.
Figure 2:
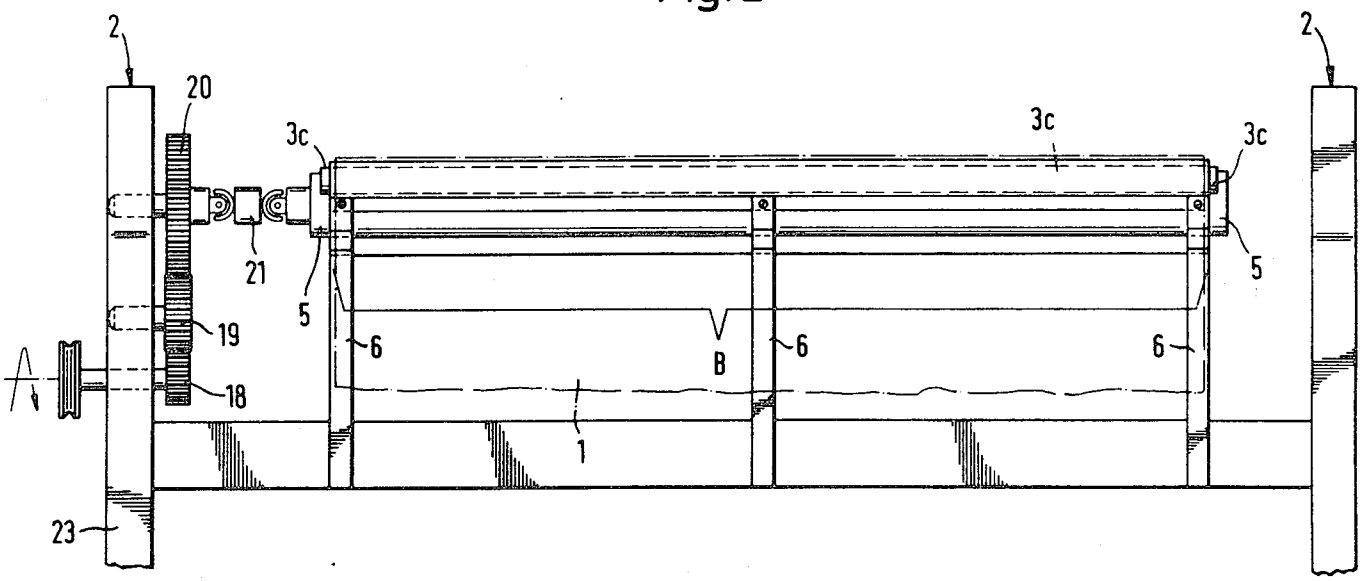
FIG. 2 is a schematic front view of the loom structure shown in FIG. 1 looking from the side of the cloth or fabric.

Describing now the drawings, there is shown in FIGS. 1 and 2 a cloth take-off apparatus for use with a textile machine, here assumed to be a loom, only enough of the structure of which has been shown to enable those skilled in the art to readily understand the underlying principles and concepts of the invention. Turning attention now to FIG. 1, it will be seen that the cloth or fabric 1, having the web width B, is delivered, in the direction of the arrow 51, over a fabric or cloth support 52 to a deflection element, here shown in the form of a deflection rod or roll 3. As best seen by referring to FIG. 3, the deflection rod 3 can contain at the rod portions or sections 38 and 39 oppositely directed or opposite pitch threaded grooves 41 and 42 exerting a spreading action upon the cloth 1 and as will be explained more fully hereinafter. Thereafter, the cloth or fabric 1 arrives at a cloth take-off roll 5 which is provided with a rubber support or jacket 4 and thereafter the cloth travels over a subsequently arranged deflection element, here shown as a deflection roll or rod 3c, at a cloth beam 65. The cloth 1 is wound-up on this conventional cloth beam or roll 65. The take-off roll 5 has a diameter D which is greater than the inner spacing A of the deflection elements 3 and 3c, in other words, greater than the spacing A between the confronting outer surfaces of such deflection elements 3 and 3c.

As best seen by referring to FIG. 2, the cloth take-off roll 5 is driven by means of the gears 18, 19 and 20 mounted in one of the side or cheek plates 23 of the machine frame 2. The drive power is transmitted from the gear 20 via a Cardan or ball-and-socket joint 21 to the take-off roll 5. Hence, this take-off roll 5 is placed in constant rotation, in other words positive cloth take-off during operation of the take-off apparatus.

While both of the deflection elements 3 and 3c are stationarily arranged and the deflection element 3c can be entrained by the cloth or fabric 1, in other words placed into rotation in the direction of the arrow 58, the take-off roll 5, due to the presence of the joint or coupling arrangement 21, is moveable transversely with respect to the lengthwise axis 62, as generally indicated by the double headed arrow 25 in FIG. 1. It is however possible to also drive the deflection roll 3c arranged following the cloth take-off roll 5 by means of any suitable drive motor or drive, as generally indicated in FIG. 1 by reference character 100. The circumferential speed of the subsequently arranged deflection roll 3c should be preferably at least as high as that of the take-off roll 5.

Continuing, it is to be understood that the entire cloth take-off apparatus has been generally designated in FIG. 1 by reference character 15. The deflection rod 3 arranged forwardly or upstream of the main take-off roll 5 is provided with a groove 53 into which engages a support or carrier 47. The support or carrier 47 is connected with a rod 55. This rod 55 is rotatably mounted in a depression or trough 56 of a holder 6 of the machine frame 2. In this way the deflection rod 3 can be rocked in the direction of the doubleheaded arrow 46, and specifically into the phantom line position 3b when the cloth 1 is to be without tension or has been removed.

During operation of the equipment the support or carrier 47 is continuously pressed against a stop or impact member 48 of the holder 6. This contact action is accomplished in that the point of rotation 57 of the rod 55 is selected such that the resultant force R, produced during operation and exerted by the fabric or cloth 1 and resulting from the cloth tension Z and the tension-force component P, extends, as shown in FIG. 1, below the point of rotation 57. Hence, during operation of the equipment there is exerted a rotational moment about the rotational point 57 which is directed in the counter-clockwise sense.

The deflection roll 3c, arranged following the take-off roll 5, is rotatably mounted in a depression or trough 22 of the frame portion or holder 6.

By virtue of the threaded grooves 41 and 42 provided at the deflection element 3 the cloth or fabric 1 which slides over such deflection element 3 can be spread wide directly prior to the time that it travels onto the cloth take-off roll 5. Then, this spread cloth 1 cannot become narrower, in other words there cannot occur any cloth contraction, due to the pronounced take-off tension P which is exerted by the take-off roll 5.

This again has the beneficial result that the cloth cannot again spread approximately at the region 71 where it departs from the cloth take-off roll 5 and arrives at the deflection roll 3c and where there prevails the appreciably lesser tension S exerted by the cloth beam 65. Thus, as tests have shown there can be advantageously avoided the formation of folds in the finished fabric or cloth 1.

It is to be mentioned that without the spreading of the cloth 1 directly at the transition between the deflection rod 3 and the take-off roll 5 there could arise a contraction in the weft direction; this could, in turn, cause a spreading at the region 71, with the result that folds or creases would be formed in the finished cloth 1, which then can be permanently impressed into the cloth or fabric 1, particularly at the contact or nip location 72.

Figure 3:
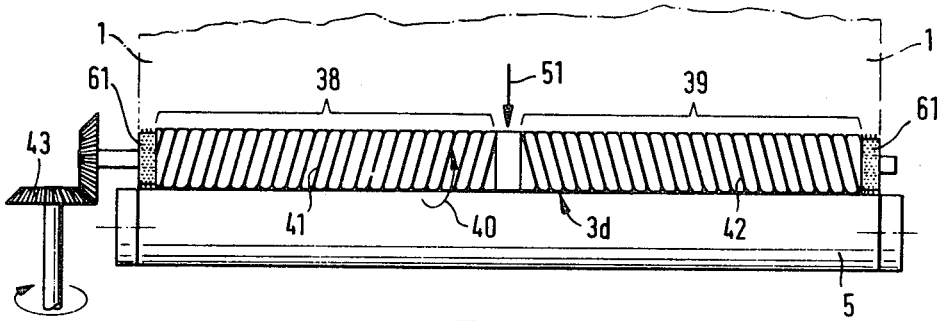
FIG. 3 is a top plan view, on a reduced scale, of part of a further construction of cloth take-off apparatus; and, FIG. 4 illustrates, like the showing of FIG. 3, still a further modification of the invention.

In the embodiment of FIG. 3, constituting a modification of the arrangement of FIGS. 1 and 2, a rotatably mounted deflection roll or element 3d, arranged forwardly of the cloth take-off roll 5, is continuously held in rotation by a suitable drive means 43. The direction of rotation, as indicated by the arrow 40, is opposite to the direction of travel 51 of the cloth or fabric 1 which passes over the deflection roll 3d. The deflection roll 3d possesses at its opposed ends needle rolls 61 rotatably mounted on roll 3d, entrained by the cloth or fabric 1, these needle rolls 61 serving for spreading the cloth or fabric 1.

Also in this case there can be realized a pronounced spreading action at the cloth or fabric 1 directly upon its travel onto the take-off roll 5.

Figure 4:
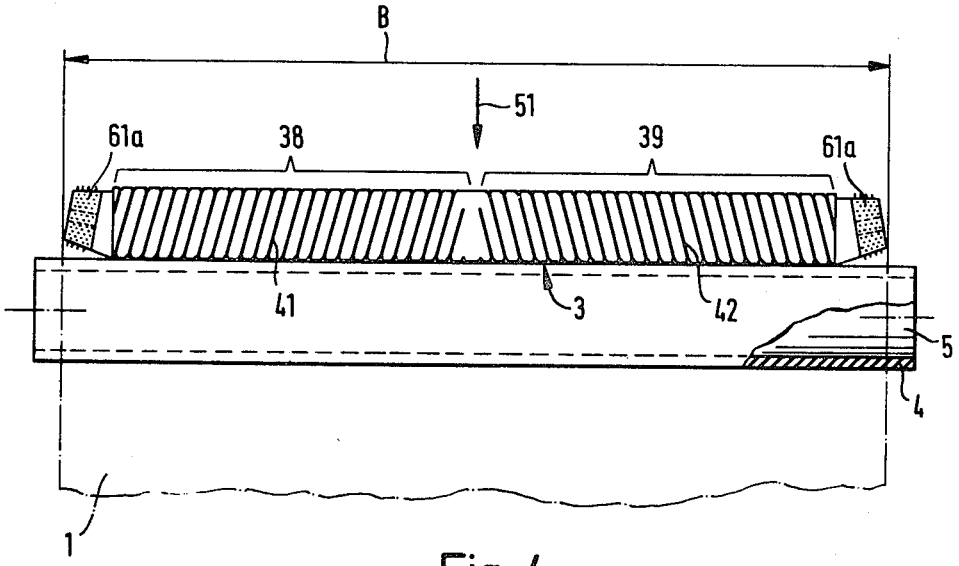

With another embodiment as shown in FIG. 4 the deflection rod or roll 3 is constructed in the manner of FIG. 1. i.e. secured against rotation. At the ends of the deflection rod 3 there are supported the inclined positioned spreader needle rolls 61a which are rotatably mounted while retaining their inclined position in space. The effective length of the deflection rod or roll 3 is accommodated to the width B of the cloth 1. The rolls 61a in conjuncton with the threaded grooves 41 and 42 or equivalent structure bring about a beneficial spreading of the cloth or fabric 1.

The deflection elements 3, 3c and 3d are mounted to be fixed in space at least during operation. The take-off roll 5 is pressed, under the action of the cloth tension Z, against the deflection elements 3, 3c and 3d, so that there can be beneficially avoided any reverse feed of the cloth or fabric 1.

While there are shown and described present preferred embodiments of the invention, it is to be distinctly understood that the invention is not limited thereto, but may be otherwise variously embodied and practiced within the scope of the followings claims. Accordingly,

What is claim is:

1. A take-off apparatus for the cloth web of a textile machine, especially a loom, comprising:

a driven cloth take-off roll;

a respective deflection element, one of which is arranged forwardly and the other of which is arranged after the take-off roll with respect to the direction of travel of the cloth;

said deflection elements serving for the deflection of the cloth and bearing against the take-off roll while the cloth is interposed therebetween;

means for mounting said deflection elements;

means for movably mounting said cloth take-off roll for movement transversely with respect to its lengthwise axis;

said deflection elements being arranged relative to one another and with respect to the cloth take-off roll such that inner spacing of both deflection elements from one another is smaller than the diameter of the cloth take-off roll;

the deflection element arranged forwardly of the cloth take-off roll being structured as a spreader device for the cloth;

said forwardly arranged deflection element comprising a rod member having two halves; and said two halves having opposite pitch threaded grooves defining said spreader grooves.

2. The take-off apparatus as defined in claim 1, wherein:

said forwardly arranged deflection element comprises a rod secured against rotation.

3. The take-off apparatus as defined in claim 1, wherein:

said means mounting said deflection elements include structure for securing the forwardly arranged deflection element against rotation.

4. The take-off apparatus as defined in claim 1, further including:

means for driving the forwardly arranged deflection element in a direction which is opposite to the direction of travel of the cloth.

5. The take-off apparatus as defined in claim 1, further including:

means for driving the deflection element arranged after the cloth take-off roll.

6. The take-off apparatus as defined in claim 5, wherein:

said drive means drives said deflection element arranged after said cloth take-off roll such that the peripheral speed thereof is at least as great as that of the cloth take-off roll.

7. The take-off apparatus as defined in claim 1, further including:

a machine frame;

a carrier for mounting the deflection element arranged forwardly of the cloth take-off roll; and said carrier being pivotably arranged at the machine frame.

8. The take-off apparatus as defined in claim 7, further including:

stop means provided for said machine frame; and said carrier being continuously pressed during operation of the take-off apparatus against such stop means of the machine frame due to the tension of the cloth.

9. The take-off apparatus as defined in claim 1, further including:

needle spreader rolls provided for said forwardly arranged deflection element.

10. The take-off apparatus as defined in claim 9, wherein:

the effective length of the forwardly arranged deflection element is accommodated to the width of the cloth;

said forwardly arranged deflection element being secured against rotation;

said needle rolls being arranged at the ends of said forwardly arranged deflection element; and said needle rolls being positioned at an inclination with respect to the ends of said forwardly arranged deflection element and being rotatably mounted at said deflection element.

11. A take-off apparatus for the cloth web of a textile machine, especially a loom, comprising:

a driven cloth take-off roll;

a respective deflection element, one of which is arranged forwardly and the other of which is arranged after the take-off roll with respect to the direction of travel of the cloth;

said deflection elements serving for the deflection of the cloth an bearing against the take-off roll while the cloth is interposed therebetween;

said deflection elements being arranged relative to one another and with respect to the cloth take-off roll such that inner spacing of both deflection elements from one another is smaller than the diameter of the cloth take-off roll; and the deflection element arranged forwardly of the cloth take-off roll being structured as a spreader device for the cloth.

* * * * *